US005558157A

United States Patent [19]

Makowski et al.

[11] Patent Number: 5,558,157

[45] Date of Patent: Sep. 24, 1996

[54] APPARATUS AND METHOD OF REMOVING MICROFOULING FROM THE WATERSIDE OF A HEAT EXCHANGER

[76] Inventors: James Makowski, 729 Chateaugay Ave., Naperville, Ill. 60540; Sunish Shah, 11934 S. Lawler; Tony Lostroscio, 3424 W. 125th St., both of Alsip, Ill. 60658; Ronald D. Wine, 2550 Fishing Creek Rd., Harrisburg, Pa. 17112; Arne A. Lindberg, 2902 Hawkshead, New Lenox, Ill. 60451

[21] Appl. No.: 358,410

[22] Filed: Dec. 19, 1994

[51] Int. Cl.[6] ..... F28G 13/00

[52] U.S. Cl. ..... 165/95; 15/301; 34/511; 34/475; 122/379

[58] Field of Search ..... 165/95; 122/379, 122/390, 395, 405; 34/511, 475, 474, 23; 15/316.1, 301

[56] References Cited

U.S. PATENT DOCUMENTS

| | | | |
|---|---|---|---|
| 908,565 | 1/1909 | Hamann | 15/316.1 |
| 1,579,262 | 4/1926 | Vickery et al. | 34/475 X |
| 3,673,632 | 7/1972 | Egnaczak | 15/316.1 |
| 4,633,593 | 1/1987 | Wallis | 34/475 |
| 4,860,821 | 8/1989 | Hagewood | 165/95 |
| 5,060,600 | 10/1991 | Brown et al. | 165/95 X |
| 5,105,558 | 4/1992 | Curry | 34/23 |
| 5,442,921 | 8/1995 | Chow et al. | 165/95 X |

FOREIGN PATENT DOCUMENTS

| | | | |
|---|---|---|---|
| 1960909 | 6/1971 | Germany | 165/95 |
| 0114623 | 9/1979 | Japan | 165/95 |

*Primary Examiner*—John Rivell
*Assistant Examiner*—Christopher Atkinson
*Attorney, Agent, or Firm*—Davis Chin

[57] ABSTRACT

An improved apparatus and method is provided for removing microfouling from the tube side of a shell-and-tube heat exchanger on a more effective and efficient basis. The tube side of the heat exchanger is isolated and drained completely of surface water while it is still on-line. A source of low relative humidity air which is dry is provided. The low relative humidity air is passed through the tube side of the heat exchanger while there is still a heat load on the shell side of the heat exchanger. The surface water is re-introduced to the heat exchanger after the tube side of the heat exchanger has been dried so as to wash away and remove the dried out microfouling from the tube side of the heat exchanger.

10 Claims, 2 Drawing Sheets

DRY SLIME WEIGHT

IN. Hg.

APPARATUS AND METHOD OF REMOVING MICROFOULING FROM THE WATERSIDE OF A HEAT EXCHANGER

BACKGROUND OF THE INVENTION

1. Field of the Invention

This invention relates generally to apparatuses for microfouling control in heat exchangers in a cooling water system of an electric power plant. More particularly, the present invention relates to an improved apparatus and method of removing microfouling from the waterside of a heat exchanger on a more efficient and effective basis.

2. Description of the Prior Art

As is generally known in the electrical power industry, large heat exchangers or condensers are used to condense steam which has been generated in boilers and passed through turbines. Typically, cooling water from a lake or river is drawn by a pump and is continuously passed through an array of sealed tubes of the heat exchanger, and the steam is directed to flow around and between the tubes of the cooling water. As a result, the steam is condensed to water. However, the cooling water contains microorganisms which thrive in the warm environment of the condenser tubes and tends to adhere to the inside or waterside surfaces of the condenser tubes and subsequently multiply rapidly to give microbial deposits or microbial slime. If this process is permitted to continue, the bore of the condenser tubes will eventually become occluded by a slime film due to the microorganisms' growth defined to be "microfouling" and thus impede the performance of the heat exchanger.

Microfouling is a major problem in power plant cooling. Microfouling can impeded heat exchanger performance in one of two ways. First, it can act as an insulator which increases the shell-to-tube side temperature differential. This reduces the efficiency of the heat exchanger. Secondly, if the slime film growth goes unchecked, it can actually reduce cooling water flow through the tubes and thus again reducing efficiency.

A number of prior art methods currently being used in the industry for heat exchanger microfouling control have generally fallen into one of the following categories:

(a) Oxidizing Biocides:

By far the most widely used method for heat exchanger microfouling control is chlorination. On-line injection of chlorine gas or sodium hypochlorite are the two most common methods of chlorination. At the correct concentration, chlorine is a very effective biocide. It is also relatively inexpensive.

In recent years, however, the U.S. Environmental Protection Agency (USEPA) has put tighter restrictions on the discharged chlorine concentration (usually measured as total residual oxidant or TRO). The tighter limits often limit the dose rate and time below that necessary to kill the microfouling. This is particularly a problem when cooling water background levels of ammonium hydroxide are high. Ammonium hydroxide reacts with the chlorine to form chloroamines which reduces the biocidal effect of chlorine without reducing the TRO. The tighter limits have essentially limited chlorination to a microfouling prevention technology only. Once a heavy microfouling film has formed, it is very difficult to remove it with short doses of low level chlorination.

A couple of methods have been used to reduce the discharge TRO while still maintaining effective microfouling control. Alternative chemicals such as chlorine dioxide and bromine chloride have been used. Sodium bromide has been used in conjunction with chlorine in waters high in background ammonium hydroxide. Targeted chlorination has also been used. This method adds the chlorine locally increasing the concentration through the heat exchanger tubes but still maintaining the lower TRO at the discharge. Both of these methods, however, become more difficult to apply as the EPA continues to ratchet the TRO limit downward.

Dechlorination is a second way that more strict EPA limits for TRO have been met. Sulfur dioxide, sodium bisulfite and sodium metabisulfite are the three most popular dechlorination chemicals used. This requires the expense of an additional chemical feed system, however. It also adds more overall chemical to the environment. Finally, some studies have shown that dechlorination reduces but does not eliminate chlorine by-products, such as trihalomethanes.

Ozonation has been used as an alternative to chlorination. The advantage to this technology is that there are no environmentally harmful by-products released to the discharge. Ozone, however, is about twice as expensive as chlorine to treat potable water. This cost differential substantially increases for the treatment of large surface cooling water flows. Ozone is also difficult to handle and must be generated on site. One further caution is that ozone can oxidize manganese and other inorganic materials that can then deposit in the condenser.

Peroxide is the last oxidizing biocide which could show future promise. It is not currently being used on a large scale basis.

(b) On-Line Mechanical Cleaning Methods:

There are several on-line mechanical cleaning technologies currently being marketed. One method recirculates sponge balls through the tube side of the heat exchanger. The balls brush off the microfouling as they circulate through the tubes. A second method uses brushes which are caged in place at each end of the heat exchanger tube. The brushes move back and forth through the tube each time cooling water through the exchanger is reversed. Again the microfouling is scraped off the tube with each pass. Both of these methods require high capital expenditures to install. Often there is not enough space to install a retrofit system. Debris carried into the heat exchanger waterbox poses another difficulty for these systems as it often blocks tubes from the mechanical cleaners.

Another on-line mechanical method currently marketed is a once-through scraper plug design. The plugs are added to the heat exchanger waterbox intakes while online. After passing through the heat exchanger waterbox, the plugs are collected at the discharge. This method has a relatively high operating cost.

Abrasive cleaning, in which sand, glass beads or other abrasives are introduced into the heat exchanger tubes to remove microfouling, is another microfouling control method. Finally, ultrasonic cleaning has shown some success for small heat exchangers.

(c) Ultraviolet Radiation (UV):

UV has proven an effective chlorination alternative for many applications. UV efficiency, however, is impacted by suspended solids. Filtration is generally required, therefore, prior to UV application. This will generally make UV cost-prohibitive for once-through cooling water systems (d) Off-Line Mechanical Cleaning:

Scraper plugs, scraper brushes and water guns have been used to remove heat exchanger tube microfouling. These methods require draining the waterbox and individually shooting water or a plug through each tube. Many large heat exchangers such as utility condenser waterboxes have thousands of tubes. Therefore, this is a very labor intensive and time-consuming process.

(e) Water Heat Treatment for Macrofouling Control:

This technology circulates heated water through the heat exchanger to remove the biofouling. It has generally been used to remove macrofouling such as for Zebra Mussel control. It differs from the method described herein in that it does not dry out the biofouling but rather heats it in water above the species tolerance level.

(f) Off-Line Tube Air Drying:

Drying the tube side of the heat exchanger while the unit is off-line has been used hereinbefore to dry out and remove microfouling. This method is the most similar to the method of the present invention described herein. With this method an off-line heat exchanger tube side is dried with ambient air, usually by fans or air movers.

The following differences are noted between this past practice and the method of the present invention described herein:

1. In past practices, the heat exchanger tube sides were only dried during outages when the unit was off-line. This had the following disadvantages:
   (i) It failed to take advantage of the steam heat load to the outside of the heat exchanger tubes found when the unit is on-line. This heat load plays a significant role in drying the heat exchanger tubes in a shorter period of time.
   (ii) Depending on the heat exchanger, taking the unit off-line is generally very expensive.
2. Past practices used only ambient air to dry the waterbox. This takes considerably longer than dehumidified air.

A prior art search directed to the subject matter of this application in the U.S. Patent and Trademark Office revealed the following U.S. Letters Patent:

| | |
|---|---|
| 4,302,546 | 4,686,853 |
| 4,531,571 | 4,703,793 |
| 4,552,659 | 4,997,574 |
| 4,631,135 | 5,276,285 |

In U.S. Pat. No. 4,531,571 to Robert D. Moss issued on Jul. 30, 1985, there is disclosed a method for feeding chlorine to a heat exchanger for biological fouling control by targeting the feed to only a few tubes at a time. The assembly is comprised of a manifold surrounded by a seal which directly contacts the condenser tube sheet so as to feed chlorine to only a few selected condenser tubes at a time. The seal serves to restrict the flow of water through the tubes so as to increase the contact time between the chlorinated water and the fouling mass in the tubes. The manifold is driven across the entire condenser tube sheet so that all the tubes are chlorinated for the same duration.

In U.S. Pat. No. 4,552,659 to N. Tabata et al. issued on Nov. 12, 1985, there is disclosed an apparatus for preventing biofouling caused by deposition and propagation of shellfish and algae in a cooling water system, using sea water or river water, in a power plant by periodically feeding ozone at high concentration to the system. An ozonizer is combined with an ozone-adsorbing and desorbing device so as to store ozone by adsorbing of an adsorbent and for a long time at low temperatures and desorbing ozone by periodically sucking at high temperatures if desired, by a water ejector.

There is shown in U.S. Pat. No. 4,631,135 to J. E. Duddridge et al. issued on Dec. 23, 1986, a method for reducing or inhibiting of biofouling by contacting the medium capable of causing biofouling with a support material such as synthetic plastic foam. The biological material is thus caused to form on the support material in preference to a part of the system.

There is shown in U.S. Pat. No. 4,997,574 to N. Sarunac issued on Mar. 5, 1991, a method and system for biofouling control in which chlorine, hot water and/or some other control agent is injected by plural stages into the boundary layer. Chlorine residual, water temperature, or some other respective control parameter is maintained in the boundary layer just upstream of the next injection point.

The other remaining patents listed above but not specifically discussed are deemed to be of general interest and to show the state of the art in microfouling control technologies.

None of the prior art discussed above disclose an apparatus and method of removing microfouling from the waterside of a heat exchanger like that of the present invention. The present invention employs an on-line dehumidification method utilizing low relative humidity air for drying the inside surfaces of the tubes of the heat exchanger while the steam side of the heat exchanger is still in service.

SUMMARY OF THE INVENTION

Accordingly, it is a general object of the present invention to provide an improved apparatus and method of effectively removing microfouling from the waterside of a heat exchanger, but overcomes the disadvantages encountered in the prior art technologies for microfouling control.

It is an object of the present invention to provide an improved apparatus and method of effectively removing microfouling from the waterside of the heat exchanger without the use of chemicals, making it more friendly both environmentally and from an industrial hygiene point of view.

It is another object of the present invention to provide an improved apparatus and method of effectively removing microfouling from the waterside of a heat exchanger which is more economical to utilize than any traditional microfouling control technologies since it does not require significant costs for cleaning and costs of replacement power while a particular heat exchanger unit is off-line for cleaning.

It is still another object of the present invention to provide an improved apparatus and method of effectively removing microfouling from the waterside of a heat exchanger which employs low relative humidity air while the steam side of the heat exchanger is still in service.

In accordance with these aims and objectives, the present invention is concerned with the provision of an apparatus and method for removing microfouling from the tube side of a shell-and-tube heat exchanger. Initially, the tube side of the heat exchanger is isolated and drained completely of surface water while it is still on-line. A source of low relative humidity air which is dry is provided. The low relative humidity air is passed through the tube side of the heat exchanger while there is still a heat load on the shell side of the heat exchanger. The surface water is re-introduced to the heat exchanger after the tube side of the heat exchanger has been dried so as to wash away and remove the dried out microfouling from the tube side of the heat exchanger.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 1:
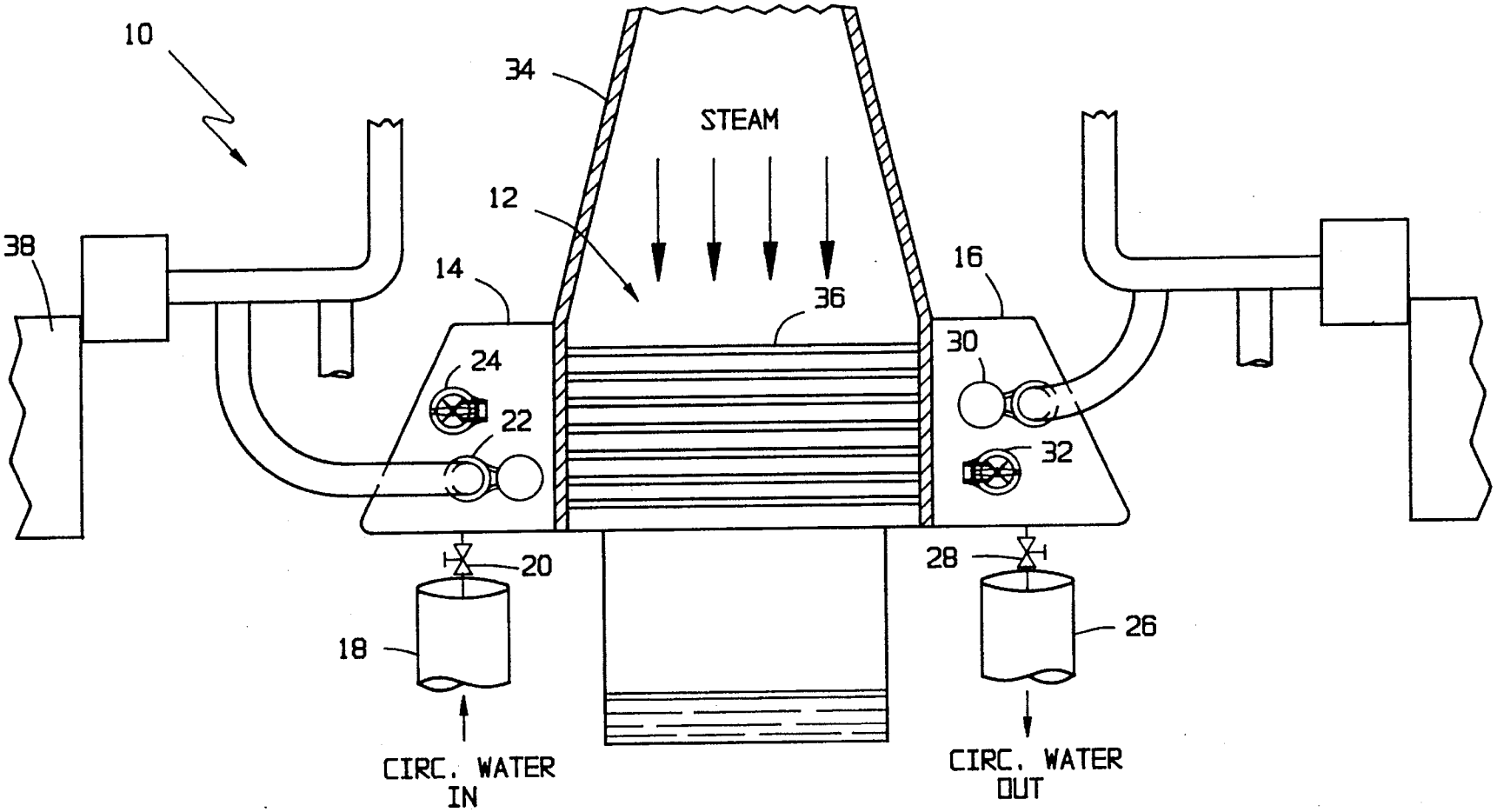
FIG. 1 is a diagrammatical view of an apparatus for removing microfouling from the waterside of a heat exchanger, constructed in accordance with the principles of the present invention.

Referring now to FIG. 1 of the drawings, there is shown and improved apparatus 10 and a method of removing microfouling from the waterside of a heat exchanger on a more effective and efficient basis which is constructed in accordance with the principles of the present invention. While the shell-and-tube heat exchanger 12 has specific application as a utility turbine condenser in a water cooling system in an electric power plant, it should be clearly understood that the method of the present invention is applicable to a variety of heat exchanger designs.

The utility turbine heat exchanger 12 has an inlet cooling waterbox 14 formed on its one side and has an outlet cooling waterbox 16 formed on its other side. A circulating water inlet conduit 18 has its one end suitably connected to a source of cooling water such as from a lake or river. The other end of the water inlet conduit 18 is operatively connected to the inlet waterbox 14 via an inlet control valve 20. The inlet waterbox 14 is also provided with a plurality of access entrance doors 22 and 24 through which a source of low relative humidity air can be supplied.

Similarly, a circulating water outlet conduit 26 has its one end suitably connected to a discharge point for returning the heated water to the lake or river. The other end of the water outlet conduit 26 is operatively connected to the outlet waterbox 16 via an outlet control valve 28. The outlet waterbox is likewise provided with a plurality of access exit doors 30 and 32 through which the source of low relative humidity air can be passed out to the atmosphere.

On the top side of the heat exchanger 12, there is provided an inlet section 34 through which a source of steam is passed therethrough and over the outer surfaces or steam side of the plurality of tubes 36 of the heat exchanger 12 so as to effect heat exchange between this steam and the cooling water being passed through the inside of the tubes.

The operation of the apparatus of the present invention for effectively removing microfouling (slime) from the inside surfaces or waterside of the tubes of the heat exchanger will now be explained. This method is referred to as "on-line dehumidification." Initially, the water inlet and outlet conduits 18 and 26 connected to the respective inlet and outlet waterboxes 14 and 16 are isolated so that the waterboxes can be taken out of service and then completely drained while the power plant is still on-line or running at a reduced output. Once the heat exchanger is drained, the circulating water inlet and outlet valves 20 and 28 are closed.

Next, the access entrance doors 22, 24 of the inlet waterbox 14 are opened. The source of low relative humidity air is supplied to the tubes 36 of the heat exchanger via the access doors in the inlet waterbox. The low relative humidity air is continuously forced through the tubes 36 and out from the access exit doors 30, 32 in the outlet waterbox 16. It will be noted that the exit doors are maintained either in their fully opened or partially opened position so as to allow this low relative humidity air to escape from the outlet waterbox 16 to the atmosphere. As the dry air is passed through the tubes and over the moist microfouling layer, a pressure vapor gradient develops. Moisture from any microfouling film deposited on the inside surfaces of the tubes will be transferred to the dry air, thereby drying out the microfouling. As the moisture in the microfouling film decreases, this film layer will shrink. When the film has completely dried, it will peel away from the interior surface of the tubes.

After the tubes of the heat exchanger and the layer of the microfouling have dried, the source of the low relative humidity air supplied to the inlet water box is shut off. Then, the access entrance doors 22, 24 on the inlet waterbox and the access exit doors 30, 32 on the outlet waterbox 16 are closed. Next, the water inlet and outlet conduits 18 and 26 are re-connected to the respective source of the cooling water and the discharge point. Finally, the circulating inlet control valve 20 and the outlet control valve 28 are opened so as to allow the return of the cooling water. As the cooling water flows again through the tubes of the heat exchanger, the cooling water will wash and remove the peeled dried out slime from the inside surface of the tubes and cause the same to be passed out the outlet discharge conduit 26.

It should be apparent to those skilled in the art that the dehumidified air can be supplied by a conventional industrial dehumidifier 38 or numerous combinations of fanned and heater assemblies that are commercially available. Further, it will be noted that the low relative humidity air passing through the tubes of the heat exchanger is lowered by two mechanisms. Firstly, the low relative humidity air generated by the dehumidifier is blown through the waterside of the heat exchanger. Secondly, the steam side of the heat exchanger tubes is being heated by the steam in the heat exchanger. This heat will raise the air temperature so as to lower the relative humidity of the air, thereby assisting in drying the slime film faster.

In order that those skilled in the art may better understand how the present invention can be practiced, the following example is given by way of illustration and not necessarily by way of limitation. The present invention was constructed and tested on a unit of a design output of 350 MW in which provided a high quality performance.

EXAMPLE

| | |
|---|---|
| No. of tubes: | 8.762 |
| Tube Diameter: | 1" OD |
| Tube Thickness: | 18 BWG |
| Tube Material: | Admiralty Brass |
| No. of waterboxes: | 2 |

Figure 2:
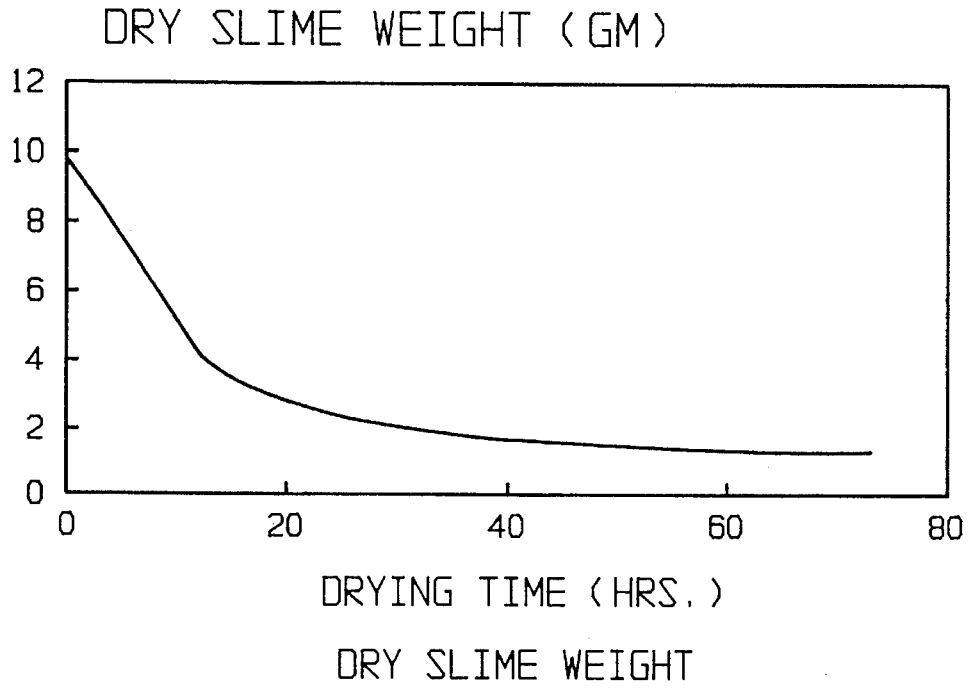
FIG. 2 illustrates a plot of microfouling removal versus drying time.

During the test period, microfouling samples were periodically collected from inside the heat exchanger tubes using a scraper plug and a fishtape. To best evaluate the overall heat exchanger cleanliness, samples were randomly taken from the tubes of the heat exchanger. The samples were than dried and weighed. Below are the results from one of the successful test runs. FIG. 2 is a graph of this data.

| Drying Time (Hours) | Slime Weight (Grams) |
|---|---|
| 0 | 9.8 |
| 7 | 4.4 |
| 25 | 1.3 |
| 73 | 1.4 |

Figure 3:
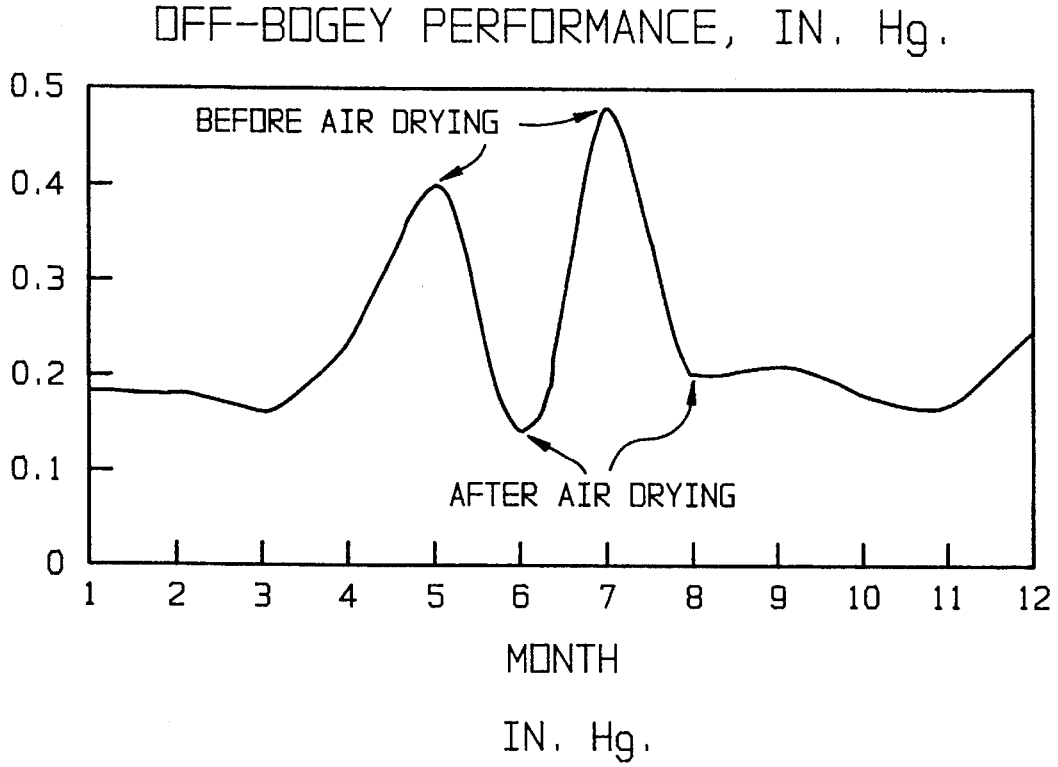
FIG. 3 is a graph illustrating how the condenser off-bogey performance is improved over time.

FIG. 3 graphs monthly average difference between the test turbine condenser heat exchanger design and actual absolute pressure. The graph shows that a significant rise in the test turbine condenser heat exchanger actual absolute pressure occurred twice during the year. These occurred because air drying application was intentionally delayed so that a microfouling film could be formed on the tube surface. The sharp decreases in the heat exchanger absolute pressure following each peak depicts regained condenser performance. These improvements directly corresponded to the heat exchanger low relative humidity air drying.

From the foregoing detailed description, it can thus be seen that the present invention provides an improved apparatus and method of removing microfouling from the waterside of a heat exchanger in a more effective and efficient basis. The present invention employs low relative humidity air which is blown through the tube side of the heat exchanger until the tubes are dried while it is still on-line. Thereafter, surface water is re-introduced through the tubes, after the tube side of the heat exchanger has been dried, so as to wash away and remove the dried out microfouling.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A method for removing microfouling from the tube side of a shell-and-tube heating exchanger, comprising the steps of:

isolating and draining completely of surface water from the tube side of said heat exchanger while it is still on-line;

passing of steam over the shell side of said heat exchanger to produce a heat load on the shell side of said heat exchanger and to add heat on the tube side of said heat exchanger so as to dry microfouling on the inside surfaces of the tubes;

providing a source of low relative humidity air which is dry;

passing said low relative humidity air through the tube side of said heat exchanger while there is still a heat load on the shell side of said heat exchanger so as to remove moisture from the microfouling and to further assist in drying the microfouling;

lowering further the relative humidity of the air due to the passing of the steam over the shell side of said heat exchanger by the added heat on the tube side of said heat exchanger so as to assist in drying of the microfouling; and re-introducing the surface water to the heat exchanger after the tube side of said heat exchanger has been dried so as to wash away and remove the dried out microfouling from the tube side of said heat exchanger.

2. A method as claimed in claim 1, wherein the surface water is river water or water from a recirculating lake system.

3. A method as claimed in claim 2, wherein the source of low relative humidity air is supplied from a dehumidifier.

4. An apparatus for removing microfouling from the tube side of a shell-and-tube heat exchanger, comprising:

a shell-and-tube heat exchanger having a plurality of tubes contained in an outer shell, the tubes having an inlet side and an outlet side;

the shell side of said heat exchanger having steam being passed over to produce a heat load on the shell side of said heat exchanger and to add heat on the tube side of said heat exchanger so as to dry microfouling on the inside surfaces of the tubes;

a first waterbox connected to the inlet side of said heat exchanger;

a second waterbox connected to the outlet side of said heat exchanger;

first controllable conduit means operatively connected to said first waterbox for supplying a source of surface water to the tube side of said heat exchanger;

second controllable conduit means operatively connected to said second waterbox for returning the surface water to the source;

entrance passage means formed in said first waterbox for passing a source of low relative humidity air through the tube side of said heat exchanger while there is still a heat load on the shell side of said heat exchanger after it has been drained so as to remove moisture from the microfouling and to further assist in drying the microfouling; and the relative humidity of the air being further lowered due to the passing of the steam over the shell side of said heat exchanger by the added heat on the tube side of said heat exchanger so as to assist in drying the microfouling; and exit passage means formed in said second waterbox for passing the humidity air into the atmosphere.

5. An apparatus as claimed in claim 4, wherein said first controllable conduit means includes an inlet control valve for isolating said first waterbox from the source of surface water.

6. An apparatus as claimed in claim 5, wherein said second controllable conduit means includes an outlet control valve for isolating said second waterbox from the return of the surface water.

7. An apparatus as claimed in claim 6, wherein said entrance passage means includes a plurality of entrance access doors.

8. An apparatus as claimed in claim 7, wherein said exit passage means includes a plurality of exit access doors.

9. An apparatus as claimed in claim 4, wherein the surface water is river water or water from a recirculating lake system.

10. An apparatus as claimed in claim 9, wherein the source of low relative humidity air is supplied from a dehumidifier.

* * * * *